US008448954B2

(12) United States Patent
Wilson

(10) Patent No.: US 8,448,954 B2
(45) Date of Patent: May 28, 2013

(54) SKATE TRUCK

(75) Inventor: Stephen S. Wilson, Las Vegas, NV (US)

(73) Assignee: SBYKE USA LLC, Las Vegas, NV (US)

( * ) Notice: Subject to any disclaimer, the term of this patent is extended or adjusted under 35 U.S.C. 154(b) by 259 days.

(21) Appl. No.: 12/963,899

(22) Filed: Dec. 9, 2010

(65) Prior Publication Data

US 2012/0146299 A1 Jun. 14, 2012

(51) Int. Cl.
*A63C 17/00* (2006.01)

(52) U.S. Cl.
USPC ..... 280/11.27; 280/87.042

(58) Field of Classification Search
USPC ..... 280/11.27, 11.28, 87.042
See application file for complete search history.

(56) References Cited

U.S. PATENT DOCUMENTS

| | | | |
|---|---|---|---|
| 322,504 | A | 7/1885 | Thompson |
| 329,556 | A | 11/1885 | Hirt |
| 329,557 | A | 11/1885 | Hirt |
| 537,689 | A | 4/1895 | Kouns |
| 638,963 | A | 12/1899 | Ganswindt |
| 865,441 | A | 9/1907 | Slocom |
| 1,213,454 | A | 1/1917 | Brown |
| 1,342,688 | A | 6/1920 | Heller et al. |
| 1,548,973 | A | 8/1925 | Burleigh |
| 1,599,223 | A | 9/1926 | Epps |
| 1,607,972 | A | 11/1926 | Mangold |
| 2,330,147 | A | 9/1943 | Rodriguez |
| 3,203,706 | A | 8/1965 | Boyden |
| 3,284,096 | A | 11/1966 | Hansen et al. |
| 3,392,991 | A | 7/1968 | Ryan |
| 3,442,528 | A | 5/1969 | Rademacher |
| 3,652,101 | A | 3/1972 | Pivonka |
| 3,860,264 | A | 1/1975 | Douglas et al. |
| 3,891,225 | A | 6/1975 | Sessa et al. |
| 3,992,029 | A | 11/1976 | Washizawa et al. |
| 4,047,725 | A | 9/1977 | Pinchock |

(Continued)

FOREIGN PATENT DOCUMENTS

| | | |
|---|---|---|
| AU | 610642 | 5/1991 |
| CN | 2501789 Y | 7/2002 |

(Continued)

OTHER PUBLICATIONS

Triton, Triton Pro, Asa Products. Asa Products, Inc. Copyright 2004. 2 pages. <http://www.asaproducts.com/PhotoGallery.asp?ProductCode=Tri%2D001+Red>.

(Continued)

*Primary Examiner* — John Walters
(74) *Attorney, Agent, or Firm* — Stetina Brunda Garred & Brucker

(57) ABSTRACT

A skate truck is disclosed which provides for a wide yaw angle for a hanger, minimal friction during yawing of the hanger, and a suspension that is dynamically stabilized based on a weight of a rider and a turn radius of a vehicle to which the skate truck is mounted. Additionally, a tension of the skate truck can be adjusted by preloading a spring which accommodates a wide weight ranger of riders. The truck may have a hanger supported between two bearings, namely, a sliding bearing system and a thrust bearing. The sliding bearings slide within grooves that define a pivot axis of the hanger. The grooves can also have various customized ramp profiles to provide a different feel during turning of the vehicle.

10 Claims, 6 Drawing Sheets

U.S. PATENT DOCUMENTS

| | | | |
|---|---|---|---|
| 4,061,351 | A | 12/1977 | Bangle |
| 4,082,307 | A | 4/1978 | Tait |
| 4,103,921 | A | 8/1978 | Brooks |
| 4,194,752 | A | 3/1980 | Tilch |
| 4,198,072 | A | 4/1980 | Hopkins |
| 4,359,231 | A | 11/1982 | Mulcahy |
| 4,469,343 | A | 9/1984 | Weatherford |
| 4,526,390 | A | 7/1985 | Skolnik |
| 4,624,469 | A | 11/1986 | Bourne |
| 4,657,272 | A | 4/1987 | Davenport |
| D289,985 | S | 5/1987 | Davenport |
| D295,428 | S | 4/1988 | Cummings |
| D295,989 | S | 5/1988 | Cummings |
| D300,756 | S | 4/1989 | Cummings |
| 4,863,182 | A | 9/1989 | Chern |
| 5,046,747 | A | 9/1991 | Nielsen, Jr. |
| 5,127,488 | A | 7/1992 | Shanahan |
| 5,551,717 | A | 9/1996 | De Courcey |
| 5,620,189 | A | 4/1997 | Hinderhofer |
| 5,839,742 | A | 11/1998 | Holt |
| 5,853,182 | A | 12/1998 | Finkle |
| 5,931,738 | A | 8/1999 | Robb |
| 5,975,546 | A | 11/1999 | Strand |
| 6,220,612 | B1 | 4/2001 | Beleski, Jr. |
| D444,184 | S | 6/2001 | Kettler |
| 6,250,656 | B1 | 6/2001 | Ibarra |
| 6,315,304 | B1 | 11/2001 | Kirkland et al. |
| 6,318,739 | B1 | 11/2001 | Fehn |
| 6,467,781 | B1 | 10/2002 | Feng |
| 6,499,751 | B1 | 12/2002 | Beleski, Jr. |
| 6,523,837 | B2 | 2/2003 | Kirkland |
| 6,572,130 | B2 | 6/2003 | Greene et al. |
| 6,595,536 | B1 | 7/2003 | Tucker |
| 6,715,779 | B2 | 4/2004 | Eschenbach |
| 6,739,606 | B2 | 5/2004 | Rappaport |
| 6,942,235 | B2 | 9/2005 | Chang |
| 7,007,957 | B1 | 3/2006 | Lee |
| 7,044,491 | B2 | 5/2006 | Kettler et al. |
| 7,140,621 | B2 | 11/2006 | Cheng |
| 7,192,038 | B2 | 3/2007 | Tsai |
| 7,540,517 | B2 | 6/2009 | Wernli |
| 8,152,176 | B2 * | 4/2012 | Wilson et al. ..... 280/11.27 |
| 2004/0012166 | A1 | 1/2004 | Reginato |
| 2005/0116430 | A1 | 6/2005 | Chen |
| 2005/0139406 | A1 | 6/2005 | McLeese |
| 2006/0042844 | A1 | 3/2006 | Kirkpatrick |
| 2006/0049595 | A1 | 3/2006 | Crigler et al. |
| 2008/0217085 | A1 | 9/2008 | Wernli |
| 2009/0066150 | A1 | 3/2009 | O'Rourke, Sr. |

FOREIGN PATENT DOCUMENTS

| | | | |
|---|---|---|---|
| DE | 4424297 | A1 | 1/1996 |
| FR | 2859111 | A1 | 3/2005 |
| FR | 2859166 | A1 | 3/2005 |
| GB | 2225990 | | 6/1990 |
| JP | 6254200 | A | 9/1994 |
| JP | 10211313A | A | 8/1998 |
| JP | 2006151032A | A | 6/2006 |

OTHER PUBLICATIONS

Wikipedia, "Caster Angle", http://en.wikipedia.org/wiki/Caster_angle; Oct. 10, 2009; 2 pages.

Mongoose Bikeboard; "Velocite Mongoose BikeBoard 24V"; http://bikeboardusa.com/velocite6_Bike_Board_24V. asp; 2007; 2 pages.

Cave, Steve; "How to Replace Skateboard Bushings"; www.about.com/od/boardmaintenane/ss/replacebushings.htm (14 pages).

Lee W. Young, Patent Cooperation Treaty, International Search Report, pp. 1-6.

* cited by examiner

SKATE TRUCK

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to a truck for a vehicle such as a skateboard or scooter.

Prior art skate trucks are fabricated in the following manner. A hanger of the skate truck pivots about a nose. The hanger is biased to the straight forward neutral position by an elastomeric member. However, the elastomeric member must be sufficiently rigid so that the rider's weight does not over power the bias force created by the elastomeric member. Additionally, the elastomeric member must be pre-tensioned to a specific amount to properly support the weight of the rider. These factors limit rotation of the hanger of the prior art skate truck to a narrow range. Moreover, there is a danger that the elastomeric member may bottom out as the rider progresses into a turn thereby inadvertently lifting the outside wheels of the skate truck.

Accordingly, there is a need in the art for an improved skate truck with a wide pivot range and a truck that can accommodate a wider weight range of riders.

BRIEF SUMMARY

The present invention addresses the needs discussed above, discussed below and those that are known in the art.

A stable skate truck that provides for a wide yaw angle and weight range of riders is provided. The skate truck has at least three (3) ball bearings that slide within grooves formed in one of either a base or hanger of the skate truck. The grooves match the ball bearings and have a ramp configuration to push the hanger away from the base as the skate truck progresses into a turn. The ramps of the grooves may have different profiles such as regressive, progressive, linear and combinations thereof to provide the rider a different feel as the rider progresses into a turn A spring is preloaded and biases the hanger towards the base so that the truck is normally in the straight forward direction. As the skate truck progresses into a turn, the ball bearings slide within the grooves and the spring is compressed to urge the ball bearings back to the center of the ramps and to urge the truck back to the straight forward direction. The spring assists in stabilizing the vehicle. A second component that stabilizes the vehicle is the centrifugal force created as the rider progresses into a turn. The centrifugal force applies a variable downward force on a deck of the vehicle based on the turn radius. The centrifugal force is translated to the ball bearings and urges the ball bearing back to the center of the ramp further urging the truck back to the straight forward direction. Another component that stabilizes the vehicle is the weight of the rider. The weight of the rider also urges the ball bearings back to the center of the ramp. Since the weight of the rider urges the ball bearings back to the center of the ramp, the preload on the spring can be used for a wider weight range of riders.

More particularly, a suspension for a vehicle is disclosed. The suspension may comprise a base, a hanger and three ball bearings. The based may be mounted to a frame of the vehicle. The base may have three semi-circularly shaped grooves within a first common plane. The three semi-circularly shaped grooves may have a first center point. The three semi-circularly shaped grooves may have a radius r. The three semi-circularly shaped grooves may define a pivot axis perpendicular to the first common plane and located at the first center point. The pivot axis may be skewed with respect to a longitudinal axis of the frame of the vehicle.

Wheels may be mounted to the hanger so that the vehicle can roll on a surface. The hanger may have three mounting recesses within a second common plane. The three mounting recesses may define a second center point wherein a distance between the three mounting recesses and the second center point is r. The second common plane of the hanger may be disposed parallel to the first common plane of the base. The second center point may be positioned on the pivot axis.

The three ball bearings may be seated within the mounting recesses and traversable along the three semi-circularly shaped grooves when the hanger rotates about the pivot axis.

The suspension may further comprise a biasing member for urging the first and second common planes closer to each other so that the ball bearings slide within the grooves as the hanger rotates about the pivot axis. The biasing member may be a compression spring.

Each of the three semi-circularly shaped grooves may have a contact surface which defines a ramp profile. The ball bearings may slide against the contact surface and compress or decompress the compression spring as the ball bearings slide against the contact surface based on the ramp profile. The ramp profiles of the three semi-circularly shaped grooves may be identical to each other. The ramp profiles may be progressive, regressive, linear or combinations thereof. Also, the three semi-circularly shaped grooves may be symmetrically identical to each other.

The suspension may further comprise a thrust bearing disposed between the compression spring and the hanger to mitigate binding between the hanger and the spring as the hanger rotates about the pivot axis.

Moreover, a vehicle with the suspension system is disclosed. In particular, the vehicle may comprise a deck and a first suspension system. The deck may define a front portion, a rear portion, a bottom surface and a top surface.

The first suspension system may be mounted to the bottom surface at the rear portion of the deck. The first suspension may comprise a base, a hanger, and three ball bearings. The base may be mounted to a frame of the vehicle. The base may have three semi-circularly shaped grooves within a first common plane. The three semi-circularly shaped grooves may have a first center point. The three semi-circularly shaped grooves may have a radius r1. The three semi-circularly shaped grooves may define a pivot axis perpendicular to the first common plane and located at the first center point. The pivot axis may be skewed with respect to a longitudinal axis of the deck.

The hanger may be used to mount wheels so that the vehicle can roll on a surface. The hanger may have three mounting recesses within a second common plane. The three mounting recesses may define a second center point wherein a distance between the three mounting recesses and the second center point is r1. The second common plane of the hanger may be disposed parallel to the first common plane of the base. The second center point may be positioned on the pivot axis.

The three ball bearings may be seated within the mounting recesses and traversable along the three semi-circularly shaped grooves when the hanger rotates about the pivot axis.

The vehicle may further comprise a second suspension system mounted to the bottom surface at the front portion of the deck. The first and second suspension systems may be mounted in opposite directions to each other. The second suspension system may also comprise a base, a hanger and three ball bearings. The base may be mounted to a frame of the vehicle. The base may have three semi-circularly shaped grooves within a first common plane. The three semi-circularly shaped grooves may have a first center point. The three semi-circularly shaped grooves may have a radius r2. The three semi-circularly shaped grooves may define a pivot axis perpendicular to the first common plane and located at the first center point.

With respect to the second suspension system, the hanger may be used to mount wheels so that the vehicle can roll on a surface. The hanger may have three mounting recesses within a second common plane. The three mounting recesses may define a second center point wherein a distance between the three mounting recesses and the second center point is r2. The second common plane of the hanger may be disposed parallel to the first common plane of the base. The second center point may be positioned on the pivot axis.

With respect to the second suspension system, the three ball bearings may be seated within the mounting recesses and traversable along the three semi-circularly shaped grooves when the hanger rotates about the pivot axis.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
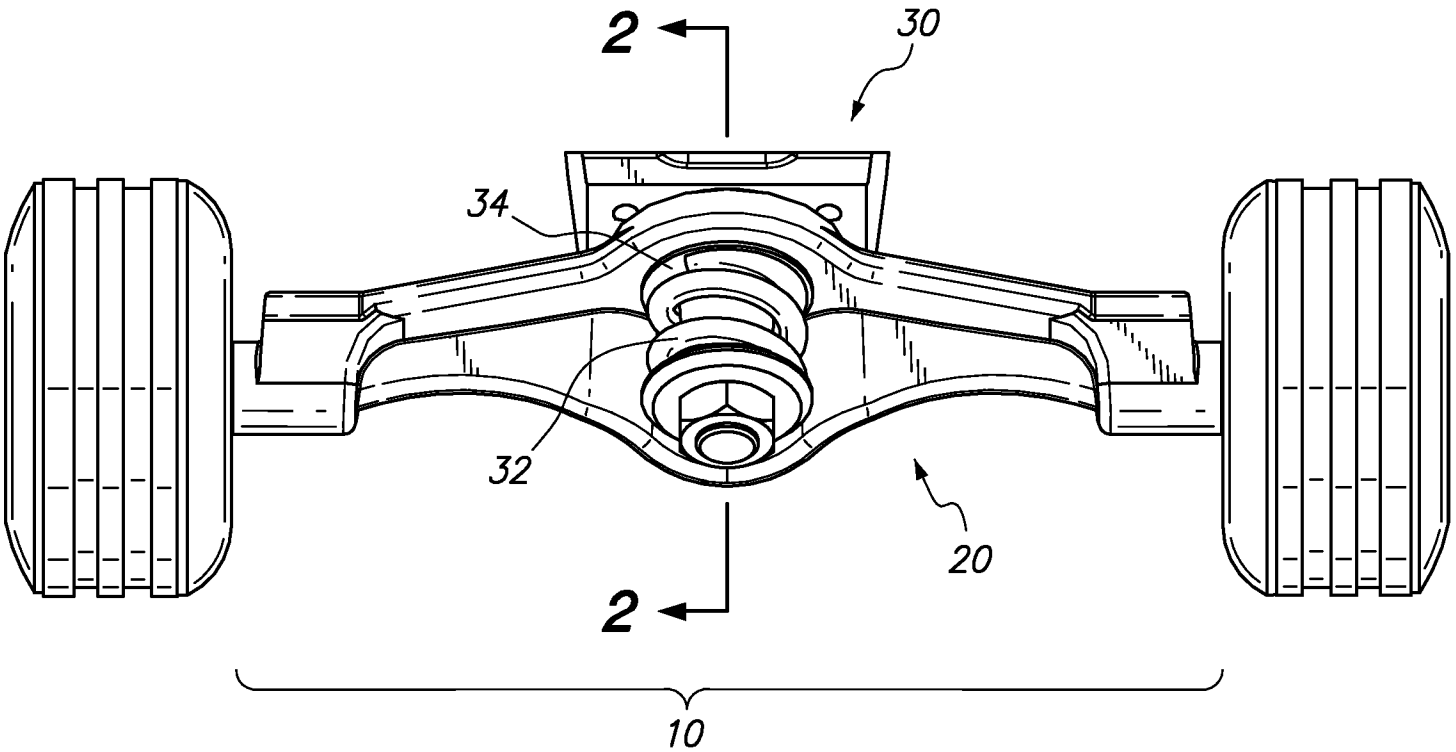
FIG. 1 is a bottom view of a skate truck.

Referring now to the drawings, a skate truck 10 is shown. The skate truck may be mounted to a bottom surface 12 of a deck 14 of a scooter, skateboard or like vehicle 16 (See FIG. 2). When the deck 14 is rotated about its central longitudinal axis 18 (see FIG. 2), a hanger 20 may be yawed about a pivot axis 22 (See FIG. 3) to turn the vehicle left or right. The pivot axis 22 is defined by three semi-circularly shaped grooves 24 *a-c* and three bearings 26 *a-c* that slide within the grooves 24 *a-c* (see FIG. 4) as the hanger 20 rotates about the pivot axis 22. The bearings 26 *a-c* are seated within mounting recesses 28 *a-c*. The grooves 24 *a-c* may have a ramp profile. The ramp profile may have left and right sides 29*a, b* (see FIG. 4) which are identical to each other so that as the rider turns left or right, the response of the skate truck 10 is identical on the left and right sides 29*a, b*. For each of the sides of the ramp profile, the ramp may push the ball bearings 26 *a-c* further away out of the groove 24 *a-c* as the rider progresses in the turn. This pushes the hanger 20 further away from the base 30. As the hanger 20 is pushed further away from the base 30, spring 32 is compressed to increase a spring force and stabilize the vehicle by biasing the vehicle 16/truck 20 back to the straight forward direction.

Three components urge the hanger 20 back to its normal straight-forward position to stabilize the vehicle during turns and straight-forward motion. In particular, the spring force of the spring 32 urges the ball bearings 26 *a-c* back to a center 31 of the ramp of the grooves 24 *a-c*. Additionally, the weight of the rider urges the ball bearings 26 *a-c* back to the middle or lowest portion 31 of the ramp defined by the groove 24 *a-c* to dynamically account for the weight of the rider. The third component is related to the centrifugal force created during turning of the vehicle 16. When the rider turns, the centrifugal force applies a variable downward force based on the turn radius onto the deck 14 of the vehicle 16. This downward force also urges the ball bearings 26 *a-c* back to the center 31 of the ramp of the grooves 24 *a-c*.

The hanger 20 is supported by the bearings 26 *a-c* and thrust bearing 34 and does not directly contact the base 30 or the spring 32. Accordingly, the rotation of the hanger 20 does not cause the hanger 20 to rub against the spring 32 or the base 30. The hanger does not bind against the base 30 and the spring 32 as the hanger 20 rotates about the pivot axis 22. As such, turning of the vehicle is smooth and effortless.

Accordingly, the skate truck 10 disclosed herein provides for a stable platform which stabilizes the vehicle 16 toward the straight-forward direction and also dynamically accounts for the weight of the rider and the turning motion to further urge the skate truck 10 back to its normal straight-forward direction. Moreover, the hanger 20 rotates about pivot axis 22 and is disposed between two sets of bearings, namely, the sliding bearings 26 *a-c* and the thrust bearings 34 so as to minimize friction, mitigate binding and promote smooth turning of the vehicle 16.

Figure 3:
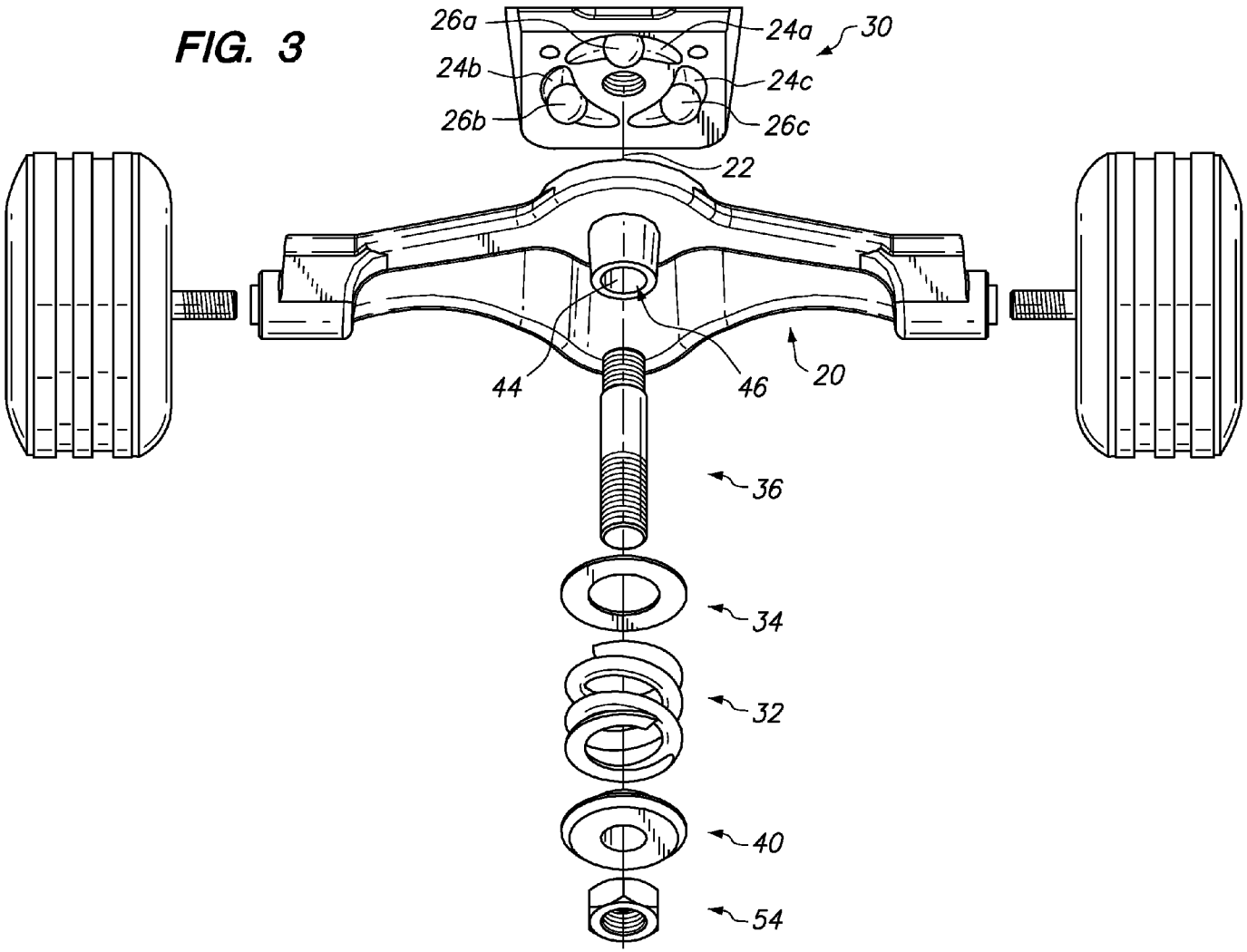
FIG. 3 is an exploded bottom view of the skate truck shown in FIG. 1.

More particularly, referring now to FIG. 1, the skate truck 10 includes the hanger 20 which is supported on both sides by thrust bearing 34 (e.g., needle thrust bearing) and sliding ball bearings 26 *a-c* (See FIG. 3). When the hanger 20 rotates about the pivot axis 22, the thrust bearing 34 mitigates binding between the spring 32 and the hanger 20. Additionally, the ball bearings 26 *a-c* slide within grooves 24 *a-c* which prevents contact between the hanger 20 and the base 30 to mitigate friction between the hanger 20 and the base 30 as the hanger 20 rotates about the pivot axis 22. Accordingly, the thrust bearing 34 and the sliding bearings 26 *a-c* mitigate friction and provide for effortless rotation of the hanger 20.

Figure 2:
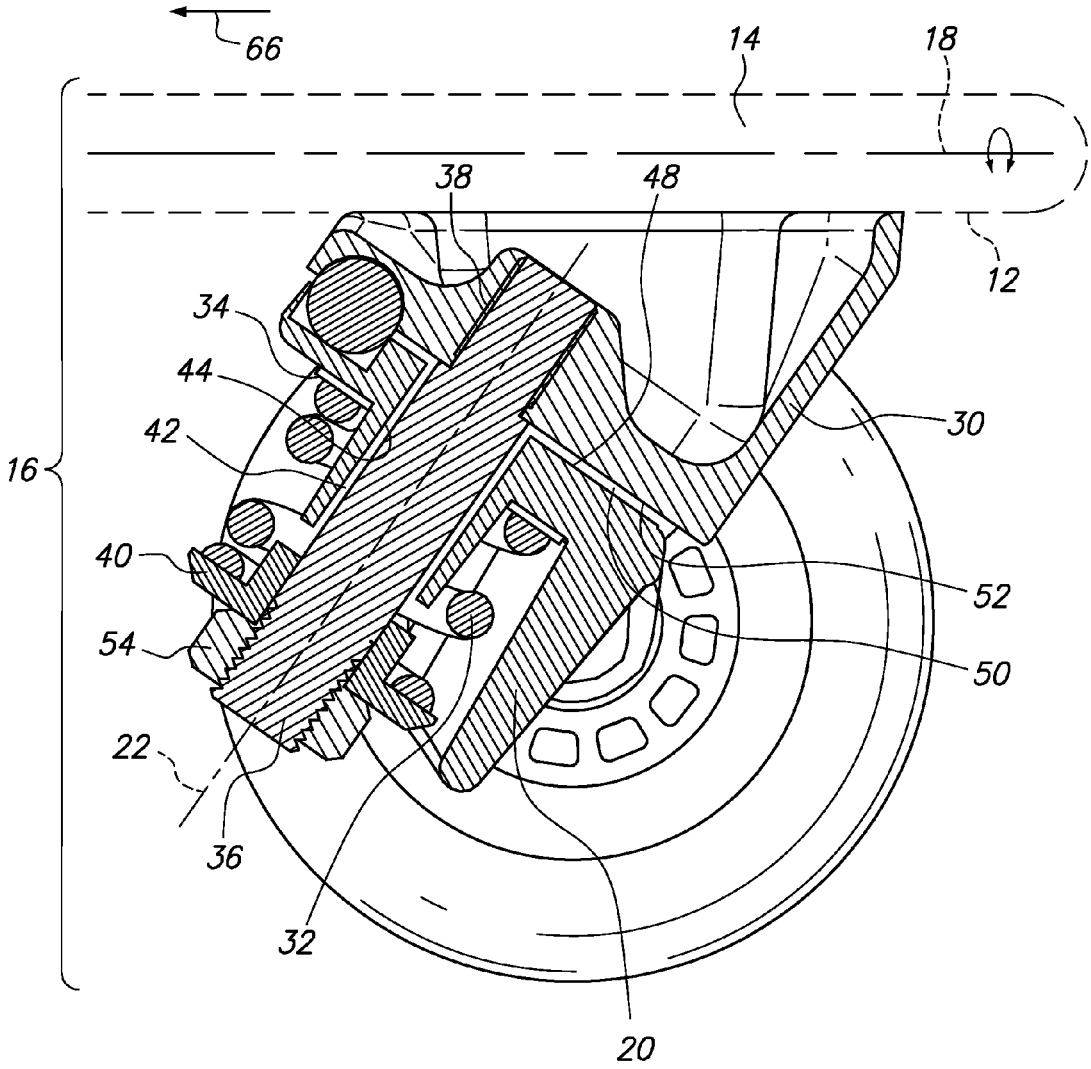
FIG. 2 is a cross sectional view of the skate truck shown in FIG. 1.

Referring now to FIG. 2, the hanger 20 is biased toward the base 30 by way of spring 32. A retaining pin 36 and a spring retainer 40 locates the spring 32. Although a compression spring is shown for spring 32, other types of springs are also contemplated. The retaining pin 36 may be threaded into the base 30 with threaded connection 38. The pin 36 may have a central axis which is aligned to the pivot axis 22. However, the pin 36 does not define the pivot axis 22 of the hanger 20. The pin 36 merely holds the assembly together. The grooves 24 a-c (see FIG. 3) formed in the base 30 define the pivot axis 22. In support thereof, the ball bearing 26 *a-c* remain fixed within the mounting recesses 28 *a-c* (see FIG. 4) of the hanger 20. The mounting recesses 28 *a-c* are all within a common plane. As the hanger 20 rotates about the pivot axis 22, all of the ball bearing 26 *a-c* contact the ramps of the grooves 24 *a-c* at the same position. The ball bearings 26 *a-c* move in unison with each other. When the hanger 20 rotates about the pivot axis 22, the ball bearings 26 *a-c* ride up and down on the ramps of the grooves 24 a-c at the same position. Since the ball bearings 26 *a-c* track the grooves 24 *a-c*, the grooves 24 *a-c* define the pivot axis 22. The retaining pin 36 merely holds the ball bearings 26 *a-c*, hanger 20, spring 32 and the spring retainer 40 together but does not determine the pivot axis 22 of the hanger 20. To further show that the retaining pin 36 merely holds the assembly together and does not define the pivot axis, a gap 42 (see FIG. 2) is shown between the retaining pin 36 and the interior surface 44 of a hole 46 (see FIG. 3) formed in the hanger 20. This illustrates that the retaining pin 36 does not guide rotation of the hanger 20 but only holds the assembly together.

Referring still to FIG. 2, a medial surface 48 of the hanger 20 is gapped 50 away from the medial surface 52 of the base 30 to mitigate rubbing friction between the hanger 20 and the base 30. A nut 54 may be threaded onto the retaining pin 36 to compress spring 32 and hold the assembly together. The nut 54 may be a self locking nut or the threaded connection may be coated with a chemical thread locker to mitigate loosening due to vibration. The spring force of the spring 32 biasing the hanger 20 toward the base 30 may be adjusted by screwing the nut 54 further down the retaining pin 36 or up off of the retaining pin 36. The nut 54 is adjusted to adjust the spring force of spring 32 to either stiffen or loosen the suspension provided by the skate truck 10. The nut adjustment is made to account for the weight of the rider. For heavier riders, the spring 32 is proloaded to a greater amount compared to a lighter rider. Regardless, since the weight of the rider also biases the truck to the straight forward direction, the spring preload for a particular rider can be used for a greater range of rider weights.

Referring now to FIGS. 5A-F, a spring force of the spring 32 as a function of degree of rotation of the hanger 20 is shown. Only one side of the ramp is shown in FIGS. 5A-F. In particular, positive rotation of hanger 20 from the straight forward direction. The other side of the ramp (i.e., negative rotation) is identical to the side shown in FIGS. 5A-F but not shown for purposes of clarity. The graphs in FIGS. 5A-F represent various potential ramp profiles of the grooves 24 *a-c*. At zero degree rotation of the hanger 20, the vehicle 16 is going straight-forward. For each degree of rotation, the ramps of the grooves 24 *a-c* urge the ball bearing 26 *a-c* up the ramp. As the ball bearings 26 *a-c* are urged up the ramp, the ball bearing 26 *a-c* push the hanger 20 away from the base 30 and the spring is deflected. Typically, total deflection or lift is about 0.200 inches. As the spring is deflected, the spring force increases linearly as the spring is deflected within its elastic range. The graphs (see FIG. 5A-F) show the spring force as a function of degree of rotation of the hanger 20 which correlates to the ramp profile of the grooves 24 *a-c*. As discussed above, the spring force of the spring 32 helps in stabilizing the vehicle 16 to bring the hanger 20 back to the straight-forward direction. As can be seen by the graphs, the spring force increases as the hanger 20 progresses into the turn.

Figure 5A:
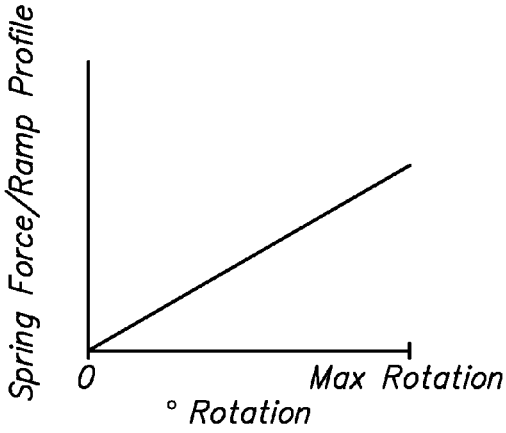
FIG. 5A is a graph illustrating spring force/ramp profile as a function of degree of rotation of the hanger illustrating a first ramp profile.
Figure 5B:
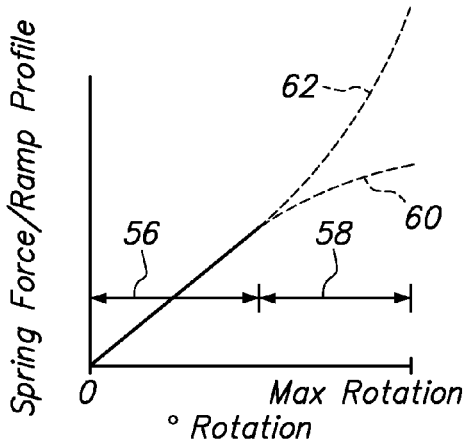
FIG. 5B is a graph illustrating spring force/ramp profile as a function of degree of rotation of the hanger illustrating a second ramp profile.
Figure 5C:
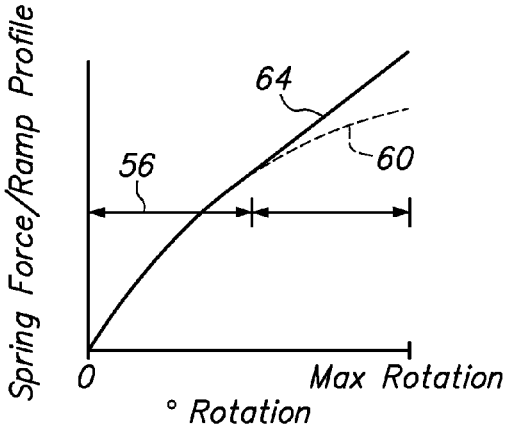
FIG. 5C is a graph illustrating spring force/ramp profile as a function of degree of rotation of the hanger illustrating a third ramp profile.
Figure 5D:
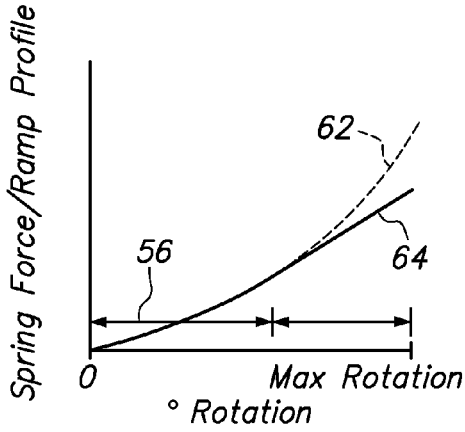
FIG. 5D is a graph illustrating spring force/ramp profile as a function of degree of rotation of the hanger illustrating a fourth ramp profile.
Figure 5E:
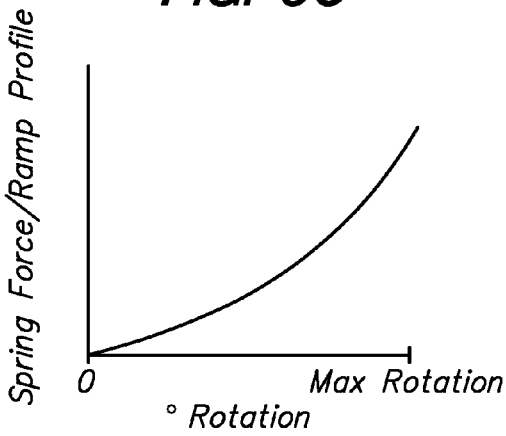
FIG. 5E is a graph illustrating spring force/ramp profile as a function of degree of rotation of the hanger illustrating a fifth ramp profile.
Figure 5F:
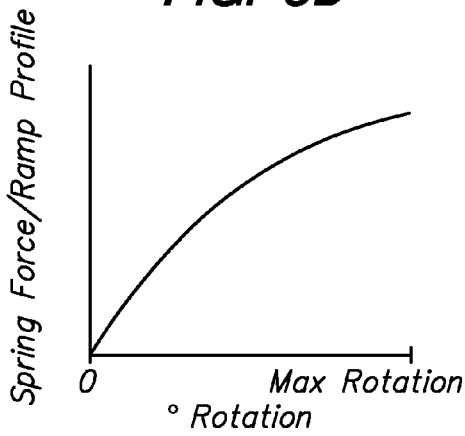
FIG. 5F is a graph illustrating spring force/ramp profile as a function of degree of rotation of the hanger illustrating a sixth ramp profile.

FIG. 5A illustrates a linear ramp profile. For each degree of rotation of the hanger 20, the spring force is increased the same incremental amount until the hanger is fully rotated and the spring force is at its maximum. In FIG. 5B, the ramp is initially linear during the first portion 56 of the hanger rotation. During the second portion 58, for each additional degree of rotation of the hanger 20, the spring force increases at a slower rate as shown by dash-line 60 which characterizes a regressive ramp profile. Alternatively, the ramp profile may be progressive in that for each additional degree of rotation of the hanger 20, the rate at which the spring force increases may accelerate as shown by dash-line 62. Referring now to FIGS. 5C and 5D, the first portion 56 may be regressive as shown in FIG. 5C or progressive as shown in FIG. 5D. The second portion 58 may be linear as shown by lines 64 or may continue on its regressive path 60 shown in FIG. 5C or may continue on its progressive path 62 as shown in FIG. 5D. FIG. 5E illustrates a progressive ramp profile throughout the entire rotation of the hanger 20. Oppositely, FIG. 5F illustrates a regressive ramp profile through the entire rotation of the hanger 20. Accordingly, the ramp profile upon which the ball bearings 26 *a-c* slide upon may have a linear profile, regressive profile, progressive profile or combinations thereof. The ramp profile can be customized to provide for a custom feel as the rider progresses through a turn on the vehicle 16.

The skate truck 10 described above was shown as having three grooves 24 *a-c*. However, it is also contemplated that more grooves 24*d-n* may be incorporated into the skate truck 10. For example, the skate truck 10 may have three or more grooves 24 *a-n*. These grooves 24 *a-n* should be symmetrically formed about a point so as to define the pivot axis 22 so that the sliding bearings 26 *a-c* apply even pressure to the ramps of the grooves 24 *a-n*. When three grooves 24 *a-c* are formed in the base 30, the grooves 24 *a-c* can allow a +/− rotation of 60 degrees or less. Preferably, the grooves 24 *a-c* are formed so as to allow for a +/− rotation of about 50 degrees. When four grooves 24 are formed in the base 30, the grooves 24 are formed to allow for rotation of the hanger 20 to about +/−45 degrees or less.

Figure 4:
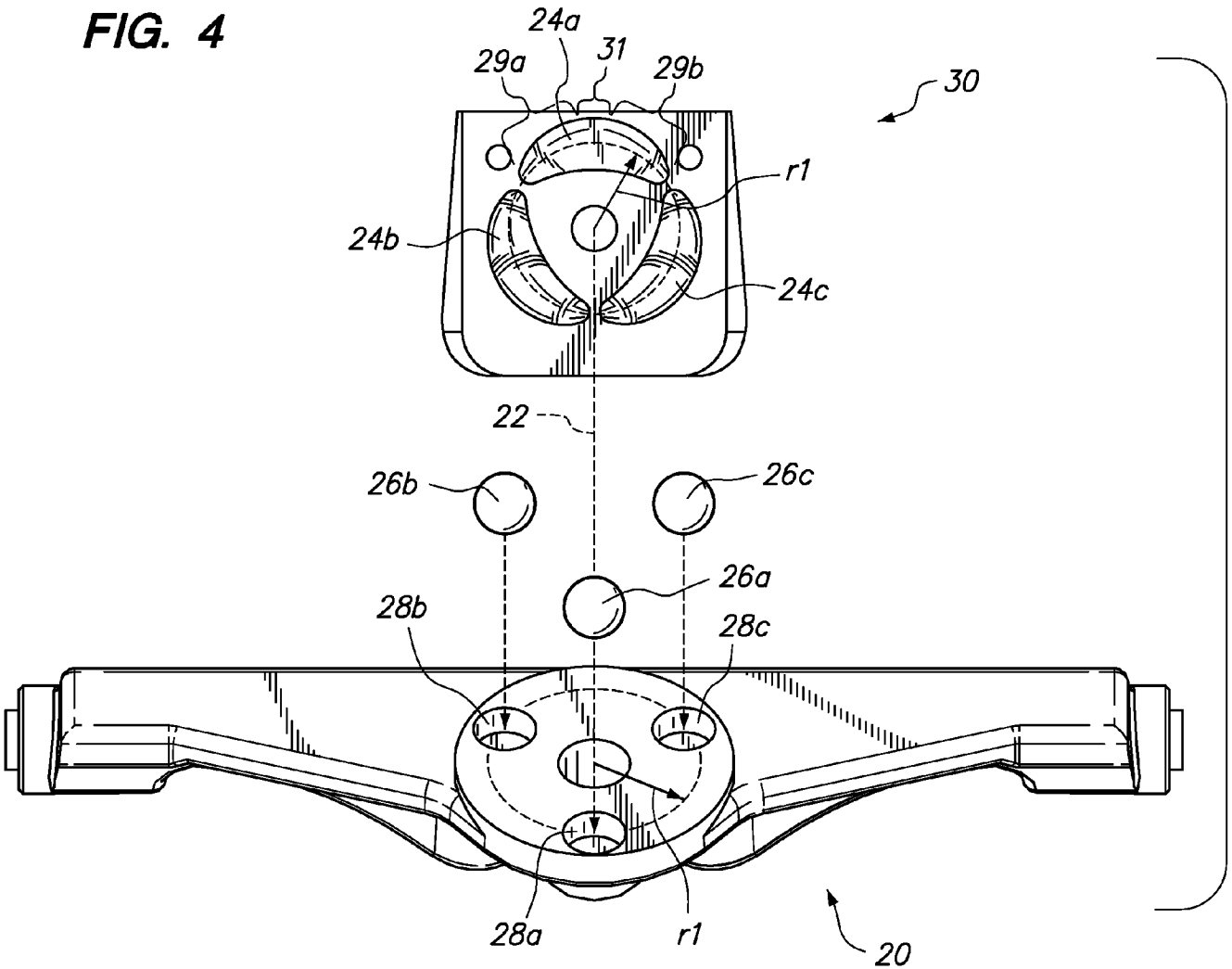
FIG. 4 is an exploded view of a base and hanger shown in FIG. 3 illustrating the assembly of the sliding bearings into grooves and mounting recesses.

Referring now to FIG. 4, the grooves 24 *a, b, c* can have a radius of r1. The center of the radius r1 defines the position of the pivot axis 22. Also, the mounting recesses 28 *a, b, c* can be positioned on a circle having a radius equal to r1.

As discussed above bearings 26 *a-c* are seated within the mounting recesses 28 *a-c*. The bearings 26 *a-c* are also disposed within the grooves 24 *a-c*. The bearings 26 *a-c* do not roll on the ramps defined by the grooves 24 *a-c*. Rather, the bearings 26 *a-c* predominantly slide on the ramp of the grooves 24 *a-c*. To facilitate sliding and not rolling of the bearings 26 *a-c*, grease can be disposed within the grooves 24 so that the sliding bearings 26 *a-c* slides on the ramps defined by the grooves 24 *a-c*. Babbitt material (e.g., zinc) may be coated on the ramps of the grooves 24 *a-c* and the bearings 26 *a-c* may be chrome finished to protect the bearings 26 *a-c* and the ramps of the grooves 24 *a-c* from the pressure created between the bearings 26 *a-c* and the ramps of the grooves 24 *a-c*

The grooves 24 *a-c* may have a semi-circularly shaped cross section and be sized to fit the bearings 26 *a-c* so that the bearings 26 *a-c* contacts the grooves 24 *a-c* along a line transverse to a curved length of the groove. The contact surface (i.e., line) sweeps or slides along the ramps of the grooves 24 *a-c* as the hanger 20 is rotated about the pivot axis 22.

Referring still to FIG. 4, the spring 32 assists in pushing the bearings 26 *a-c* to the lowest most portion 31 of the ramps defined by the grooves 24 *a-c*. In other words, the spring 32 assists in biasing the hanger 20 so that the vehicle goes in the straight forward direction. The weight of the rider also helps in urging the bearings 26 *a-c* down to the lowest most portion of the ramps defined by the grooves 24 *a-c*. This too helps in biasing the hanger so that the vehicle goes in the straight forward direction. A third component that helps in biasing the hanger so that the vehicle goes in the straight forward direction is the centrifugal force created when the rider of the vehicle 16 makes a left or right turn with the vehicle. As the rider progresses into a turn, a centrifugal force is created. The centrifugal force applies a force on the deck 14 of the vehicle 16 based on a turn radius. This centrifugal force is translated to the bearings 26 *a-c* to bias the bearings 26 *a-c* toward the lowest most portion of the ramps defined by the grooves 24 *a-c*.

The skate truck 10 can be mounted at the rear of the deck 14 in the orientation shown in FIG. 2. Arrow 66 shows the forward direction of the vehicle. The front of the deck 14 can be mounted with a second skate truck 10 mounted in a reverse orientation to the truck 10 shown in FIG. 2 so that rolling of the deck 14 turns the vehicle left or right. Other configurations are also contemplated. For example, the skate truck 10 can be mounted at the rear of the deck 14 with a stationary or pivotable single or double front wheel with or without a handle bar. The skate truck can be mounted to the front of the deck 14 with a stationary or pivotable single or double rear wheel. A handle bar can still be mounted to the front of the deck 14.

Figure 4A:
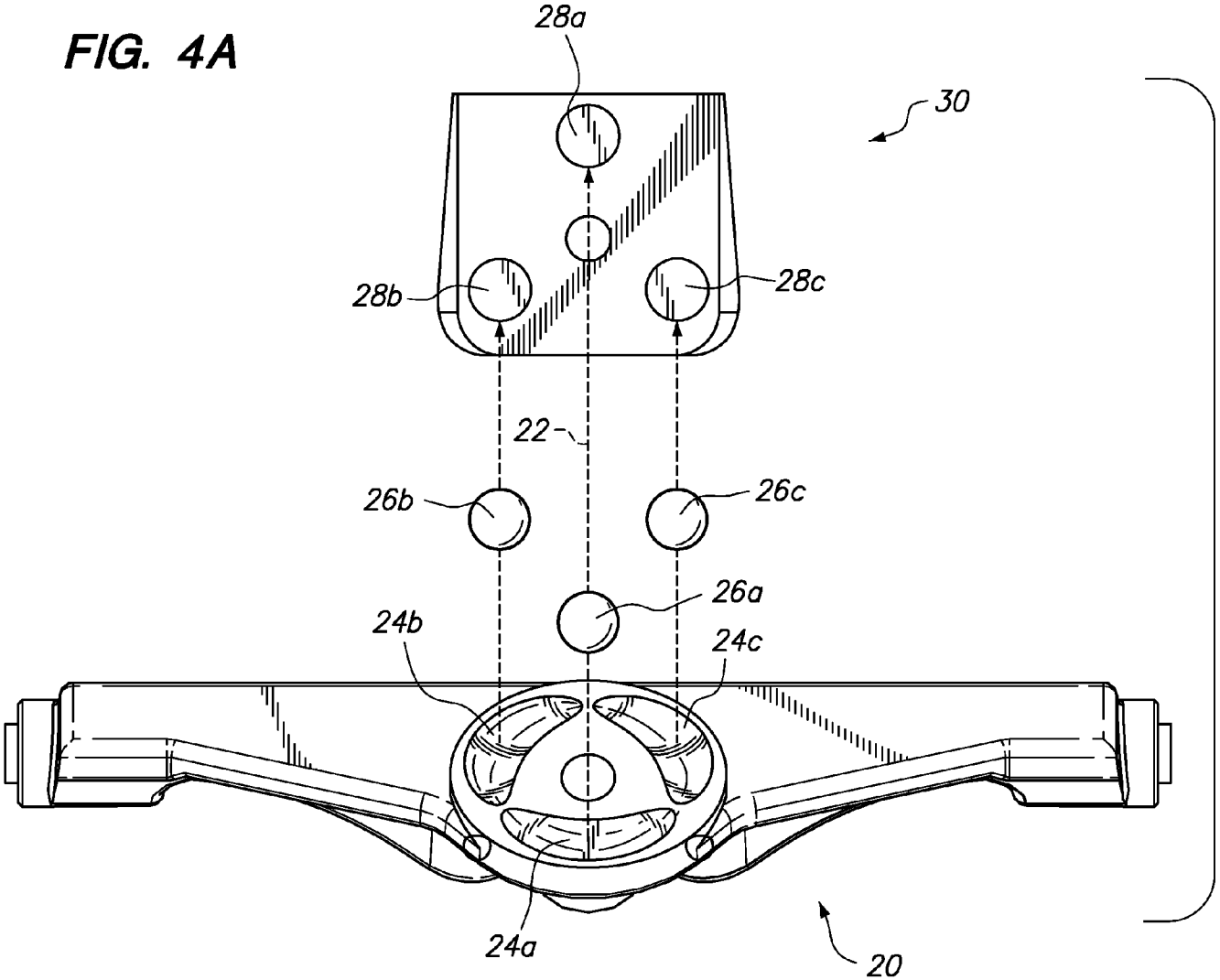
FIG. 4A is an exploded view of a base and hanger illustrating a reverse embodiment shown in FIG. 4.

Referring now to FIG. 4A, the grooves 24 *a-c* may be formed in the hanger 20 and the mounting recesses 28 *a-c* may be formed in the base 30.

The above description is given by way of example, and not limitation. Given the above disclosure, one skilled in the art could devise variations that are within the scope and spirit of the invention disclosed herein, including various ways of mounting the truck to the deck. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A suspension for a vehicle, the suspension comprising:

a base mountable to a frame of the vehicle, the base having at least three semi-circularly shaped grooves within a first common plane, the at least three semi-circularly shaped grooves having a first center point, the at least three semi-circularly shaped grooves having a radius r, the at least three semi-circularly shaped grooves defining a pivot axis perpendicular to the first common plane and located at the first center point;

a hanger for mounting wheels so that the vehicle can roll on a surface, the hanger having at least three mounting recesses within a second common plane, the at least three mounting recesses defining a second center point wherein a distance between the at least three mounting recesses and the second center point is r, the second common plane of the hanger being disposed parallel to the first common plane of the base, the second center point positioned on the pivot axis; and at least three ball bearings seated within the at least three mounting recesses and traversable along the at least three semi-circularly shaped grooves when the hanger rotates about the pivot axis.

2. The suspension of claim 1 further comprising a biasing member for urging the first and second common planes closer to each other so that the ball hearings slide within the grooves as the hanger rotates about the pivot axis.

3. The suspension of claim 2 wherein the biasing member is a compression spring.

4. The suspension of claim 3 wherein each of the at least three semi-circularly shaped grooves has a contact surface which defines a ramp profile, the at least three ball bearings slide against the contact surfaces and compress or decompress the compression spring as the at least three ball bearings slide against the contact surfaces based on the ramp profile.

5. The suspension of claim 4 wherein the ramp profiles of the at least three semi-circularly shaped grooves are identical to each other, the ramp having a progressive profile, regressive profile, linear profile or combinations thereof.

6. The suspension of claim 1 wherein the at least three semi-circularly shaped grooves are symmetrically identical to each other.

7. The suspension of claim 1 wherein the pivot axis is skewed with respect to a longitudinal axis of the frame of the vehicle.

8. A vehicle comprising:

a deck defining a front portion, a rear portion, a bottom surface and a top surface;

a first suspension system mounted to the bottom-surface at the rear portion of the deck, the first suspension comprising a base mountable to a frame of the vehicle, the base having at least three semi-circularly shaped grooves within a first common plane, the at least three semi-circularly shaped grooves having a first center point, the at least three semi-circularly shaped grooves having a radius r1, the at least three semi-circularly shaped grooves defining a pivot axis perpendicular to the first common plane and located at the first center point;

a hanger for mounting wheels so that the vehicle can toll on a surface, the hanger having at least three mounting recesses within a second common plane, the at least three mounting recesses defining a second center point wherein a distance between the at least three mounting recesses and the second center point is r1, the second common plane of the hanger being disposed parallel to the first common plane of the base, the second center point positioned on the pivot-axis; and at least three ball bearings seated within the at least three mounting recesses and traversable along the at least three semi-circularly shaped grooves when the hanger rotates about the pivot axis.

9. The vehicle of claim 8 wherein the pivot axis is skewed with respect to a longitudinal axis of the deck.

10. The vehicle of claim 8 further comprising a second suspension system mounted to the bottom surface at the front portion of the deck, the first and second suspension systems mounted in opposite directions to each other, the second suspension system comprising:

a base mountable to a frame of the vehicle, the base having at least three semi-circularly shaped grooves within a first common plane, the at least three semi-circularly shaped grooves having a first center point, the at least three semi-circularly shaped grooves having a radius r2, the at least three semi-circularly shaped grooves defining a pivot axis perpendicular to the first common plane and located at the first center point;

a hanger for mounting wheels so that the vehicle can roll on a surface, the hanger having at least three mounting recesses within a second common plane, the at least three mounting recesses defining a second center point wherein a distance between the at least three mounting recesses and the second center point is r2, the second common plane of the hanger being disposed parallel to the first common plane of the base, the second center point positioned on the pivot axis; and at least three ball bearings seated within the at least three mounting recesses and traversable along the at least three semi-circularly shaped grooves when the hanger rotates about the pivot axis.

* * * * *